United States Patent [19]

Nixon

[11] Patent Number: 4,695,765

[45] Date of Patent: Sep. 22, 1987

[54] DISPLAY ARRANGEMENTS

[75] Inventor: Ralph D. Nixon, Braintree, England

[73] Assignee: English Electric Valve Company Limited, Chelmsford, England

[21] Appl. No.: 637,036

[22] Filed: Aug. 2, 1984

[30] Foreign Application Priority Data

Aug. 5, 1983 [GB] United Kingdom ..... 8321146

[51] Int. Cl.[4] ..... H01J 1/62

[52] U.S. Cl. ..... 313/497; 313/495; 313/426

[58] Field of Search ..... 313/495, 496, 497, 426, 313/427, 432

[56] References Cited

U.S. PATENT DOCUMENTS

| | | | |
|---|---|---|---|
| 2,623,190 | 12/1952 | Roth | 313/432 |
| 3,376,447 | 4/1968 | Petit | 313/432 |
| 4,243,986 | 1/1981 | Nixon | 313/497 |

FOREIGN PATENT DOCUMENTS

| | | | |
|---|---|---|---|
| 0121262 | 9/1980 | Japan | 313/496 |
| 0723174 | 2/1955 | United Kingdom | 313/432 |
| 728053 | 4/1955 | United Kingdom . | |
| 742466 | 12/1955 | United Kingdom . | |
| 743268 | 1/1956 | United Kingdom . | |
| 1048409 | 11/1966 | United Kingdom . | |

*Primary Examiner*—David K. Moore

*Attorney, Agent, or Firm*—Spencer & Frank

[57] ABSTRACT

A display arrangement consists of a tubular envelope with fluorescent stripes running along its length, localized portions of which are illuminated by different electron guns which produce flood beams of electrons. Field electrodes which surround each electron gun determine the angular direction at which the flood beam leaves the gun and hence which one of the fluorescent stripes is caused to emit light. The stripes can be of three different primary colors, to produce a colored display.

20 Claims, 3 Drawing Figures

DISPLAY ARRANGEMENTS

BACKGROUND AND SUMMARY OF THE INVENTION

This invention relates to display arrangements which are capable of producing bright, readily alterable displays.

According to this invention, a display arrangement includes an evacuated envelope having a fluorescent screen and an electron gun which is capable of producing a flood beam of electrons which falls upon said screen, the screen having three distinct adjacent localized areas which emit light of three different primary colors respectively in response to incident electrons, the electron gun comprising a cathode and two field electrodes positioned one on each side of the cathode and arranged to shape the flood beam which emerges from said gun, the three localized areas of the screen being such that the undeflected flood beam falls upon one of them, and such that the flood beam is deflected to fall upon the other two localized areas respectively in response to potentials of said field electrodes of the same value but of opposite effect.

Three different localized areas of the screen can be associated with a particular flood beam, and each of these areas carries a different color phosphor, e.g. red, green, blue, so that by altering the angle at which the beam emerges from the gun, the color of the display can be changed. This angle is selected by applying predetermined potentials of low magnitude to the two field electrodes.

Preferably a mesh electrode is positioned between the screen and the cathode, and carries a relatively low potential, so that the customary very high potential which is applied to the screen does not influence the operation of the gun.

DESCRIPTION OF THE PREFERRED EMBODIMENT

Figure 1:
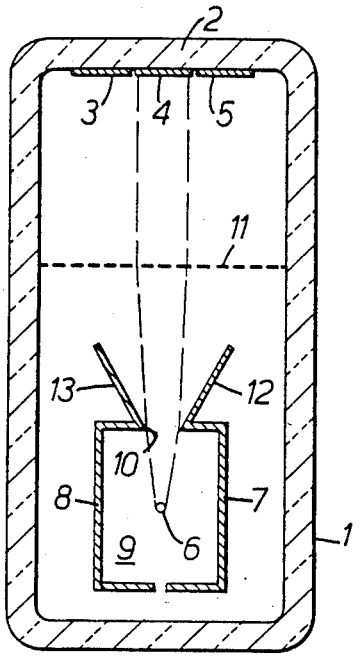
FIGS. 1 and 2 illustrate cross-sectional views of a display arrangement in accordance with the present invention and FIG. 3 is a longitudinal section view.

Referring to the drawing, the display arrangement consists of a long tubular glass envelope 1 of approximately rectangular cross-section, a portion of which constitutes a fluorescent screen 2 and carries three longitudinal stripes 3, 4 and 5 of red, green and blue phosphor respectively. The envelope is sealed at both ends (not shown) and is evacuated to a high level of vacuum. A single elongate cathode 6 is positioned towards the end of the rectangular section which is away from the screen 2, and on either side of the cathode 6 is a respective field electrode 7 and 8. The two electrodes together with the cathode 6 constitute an electron gun 9 which is arranged to produce a flood beam of electrons, the width of which is determined primarily by the opening 10 between the mouths of the two electrodes 7 and 8. A mesh electrode 11 is positioned between the electron gun and the screen 2.

In operation, emission of electrons from the electron gun 9 can be controlled by the potentials applied to the field grids 7 and 8. By controlling the angle at which the electron beam emerges, it can be caused to strike just one of the three stripes 3, 4 and 5 so that a red, green or blue patch of light can be selected at will.

FIG. 1 shows the trajectory of the electron flood beam when no lateral deflection is applied to it so that it strikes the green stripe 4 and produces a correspondingly colored patch of intense illumination. Under these conditions, typical voltages are as follows. A very high potential is applied to the inner surface of the screen 2 and is typically about +7 KV. The mesh electrode is held at +10 V and both field electrodes 7 and 8 are held at the same potential of +10 V. All potentials are with respect to the nominal earth potential of the cathode 6.

As both field electrodes 7 and 8 are at the same potential, the electrons which are emitted from the cathode 6 experience a net positive electrostatic field, and are accelerated towards the mesh electrode 11. It will be noted that the width or spread of the flood beam in a direction transverse to the axis of the cathode, is dictated by the width of the slotted opening 10, and that the flood beam electron continues to diverge in an almost linear manner until it reaches the mesh electrode 11 which is held at +10 V. The extensions 12, 13 of the field electrodes 7 and 8 assist in controlling the profile of the flood beam as it leaves the electron gun. When the electrons reach the mesh electrode 11, they are greatly influenced by the very high potential on the screen and are accelerated in a very rapid manner so that they strike the screen with high energy.

In practice, the brightness of the display is determined by pulse width modulating the potential on the field electrodes, i.e. controlling the duration of the pulses applied to it. In this case, the cathode is a directly heated filament, that is to say its temperature is raised to that at which copious emission of electrons takes place by passing an electric current through it. The resistance of the filament is chosen so as to provide the required temperature rise. By pulsing the current along the filament instead of passing it continuously, the variation of potential along the filament can be prevented from causing brightness variations across the screen. Thus, the current pulses are applied to the filament only while the electron beam is not permitted to leave the electron gun. The device is turned off, i.e. the electron beam is contained within the electron gun by applying a potential of −2 V to the field electrodes 7 and 8 with respect to the cathode 6. The pulse repetition rate of the pulses applied to the field electrodes should be well above the flicker threshold of the eye, so that an observer sees a continuously present display.

Figure 2:
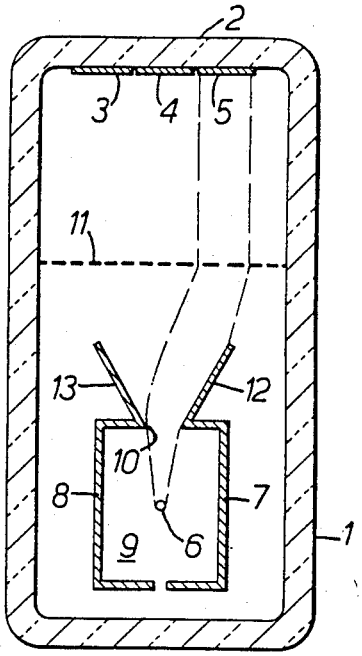

When it is desired to illuminate a different one of the phosphor stripes, for example stripe 5 which is blue, all of the previously stated potentials, which were applied while a green patch of light was produced, remain the same except for the values of the two potentials which are applied to the field electrodes 7 and 8. In order to produce the angular deflection illustrated in FIG. 2, a potential of about +12 V is applied to field electrode 7 and a potential of +8 V is applied to field electrode 8.

By interchanging the application of the potentials to the two field electrodes, the red phosphor stripe 3 can be illuminated.

Alternatively, the device as a whole can be turned on and off by applying a suitably negative potential to the mesh electrode 11, but this is not preferred if the mesh electrode is common to a plurality of electron guns which are to be operated independently of each other.

Figure 3:
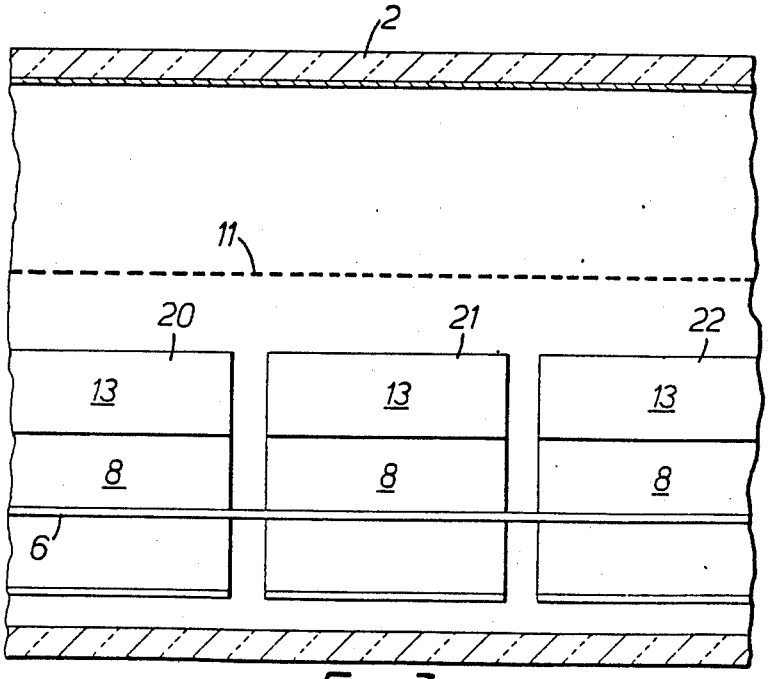

Referring to FIG. 3, a longitudinal view of the display device is shown and it will be seen that a plurality of electron guns 20, 21 and 22 are mounted within the common elongate envelope along which the single continuous cathode 6 passes. Each electron gun consists simply of a respective pair of field electrodes in combination with the cathode, but in FIG. 3 only the field electrodes 8 are visible. By applying common potentials to the field mesh 11 and to the fluorescent screen 2, it is necessary only to apply selectively switchable potentials to the field electrodes 7 and 8 of each electron gun in order to either turn that gun on or off or select a particular color.

It will be noted that the field electrodes constitute the entire electron gun in combination with a filamentary cathode but they can nevertheless produce a flood beam of electrons of controlled intensity and beam width. In addition, the angle at which the electron beam emerges from the gun can be finely controlled entirely by adjusting the relative potentials on the two field electrodes. Once the potentials have been adjusted, it is merely necessary to apply one of the three predetermined sets of potential values to the field electrodes 7 and 10 to produce a visible display of the required color. A large number of separate electron guns can be mounted in a single tubular envelope 1, and a large number of tubular envelopes can be mounted side by side to produce a large two-dimensional display area with extremely good optical resolution, and excellent control over the color of the separate pixels in the display.

What I claim is:

1. A display arrangement including an evacuated envelope having a fluorescent screen and an electron gun which is capable of producing a flood beam of electrons which falls upon said screen, the screen having three distinct adjacent localized areas which emit light of three different primary colors respectively in response to incident electrons, the electron gun comprising a cathode and two field electrodes positioned one on each side of the cathode and arranged to shape the flood beam which emerges from said gun, the three localized areas of the screen being such that the undeflected flood beam falls upon one of them, and such that the flood beam is deflected to fall upon the other two localized areas respectively in response to potentials of said field electrodes of the same value but of opposite effect.

2. A display arrangement as claimed in claim 1 and wherein the flood beam is shaped in relation to the size of the three localized areas such that it is capable of falling wholly upon just one of the areas at a time.

3. A display arrangement as claimed in claim 1 and wherein the envelope is of an elongate tubular shape with a plurality of separate electron guns positioned along its length.

4. A display arrangement as claimed in claim 3 and wherein the plurality of electron guns share a common filamentary cathode.

5. A display arrangement as claimed in claim 1 and wherein a plurality of fluorescent stripes run longitudinally along the length of the elongate envelope with portions of the different stripes constituting said selected localized areas.

6. A display arrangement as claimed in claim 1 and wherein a mesh electrode is positioned between the screen and the cathode.

7. A display arrangement as claimed in claim 5, and wherein three contiguous parallel stripes are positioned in relation to the electron gun so that the central stripe is radiated by an undeflected flood beam, and the two outer stripes are respectively radiated by the flood beam when it is subjected to a predetermined angular deflection to one side or the other of the direction of the undeflected beam.

8. A method of operating a display arrangement as claimed in claim 1, and wherein four different sets of predetermined potentials are selectively applied to the two electrodes, such that one set produces emission from the electron gun of an undeflected flood beam of electrons, the second set produces emission of the beam at a predetermined angular direction to one side of the direction of the undeflected beam, the third set produces emission of the beam at a predetermined angular direction to the other side of the direction of the undeflected beam, and the fourth set inhibits emission of the beam from the electron gun.

9. A display arrangement, comprising:

an evacuated envelope having a screen that is disposed in a plane, the screen having first, second, and third localized areas which emit light of three different primary colors respectively in response to incident electrons, the screen being maintained at a positive high voltage;

a cathode disposed in the envelope at a position spaced apart from the screen;

a mesh electrode between the cathode and the screen and spaced apart from the cathode and the screen, the mesh electrode being disposed in a plane that is parallel to the plane of the screen and being maintained at a positive voltage that is substantially less than the voltage of the screen, the mesh electrode including a first region corresponding to the first localized area of the screen, so that a line perpendicular to the plane of the screen at the first localized area passes through the first region of the mesh electrode, a second region corresponding to the second localized area of the screen, so that a line perpendicular to the plane of the screen at the second localized area passes through the second region of the mesh electrode, and a third region corresponding to the third localized area of the screen, so that a line perpendicular to the plane of the screen at the third localized area passes through the third region of the mesh electrode; and field electrode means disposed around the cathode for emitting a flood beam of electrons that is dimensioned to fall on a single region of the mesh electrode and for selectively directing the flood beam, the field electrode means including first and second field electrodes which are spaced apart to provide an opening for the flood beam, with the first field electrode being maintained at a first positive voltage and the second field electrode being maintained at a second positive voltage that is less than the first voltage to direct the flood beam toward the first region of the mesh electrode, with both field electrodes being maintained at a third positive voltage that lies between the first and second voltages to direct the flood beam to the second region of the mesh electrode, and with the first field electrode being maintained at the second voltage and the second field electrode being maintained at the first voltage to direct the flood beam to the third region of the mesh electrode.

10. A display arrangement as claimed in claim 9, wherein the first, second, and third localized areas of the screen comprise first, second, and third fluorescent stripes having axes that are parallel to one another, each stripe having a width that is substantially the same as the width of the flood beam of electrons.

11. A display arrangement according to claim 9, wherein the cathode comprises an elongated filament having an axis that is parallel to the plane of the screen.

12. A display arrangement according to claim 9, wherein the cathode is maintained at ground potential, wherein the first voltage is eight volts, wherein the second voltage is ten volts, and wherein the third voltage is twelve volts.

13. A display arrangement according to claim 9, wherein the envelope is elongated and has an axis that is parallel to the plane of the screen and the plane of the mesh electrode, wherein the first, second, and third localized areas of the screen comprise first, second, and third fluorescent stripes having axes that are parallel to the axis of the envelope, wherein the cathode comprises an elongated filament having an axis that is parallel to the axis of the envelope, and further comprising a plurality of additional field electrode means that are disposed along the filament.

14. A display arrangement as claimed in claim 1 and wherein the cathode comprises a substantially straight filament which is disposed between and substantially surrounded by the two field electrodes.

15. A display arrangement as claimed in claim 1 and wherein the flood beam is shaped by the electron gun in relation to the size of the three localized areas such that it is capable of falling wholly upon just one of the areas at a time.

16. A display arrangement as claimed in claim 1 and wherein the envelope is of an elongated tubular shape with a plurality of separate electron guns positioned along its length, each electron gun producing a respective flood beam of electrons, and wherein the electron guns share a common filamentary cathode.

17. A display arrangement according to claim 9, wherein the cathode comprises a substantially straight filament which is disposed between and substantially surrounded by the first and second field electrodes.

18. A display arrangement according to claim 9, wherein the first, second, and third voltages are DC voltages.

19. A display arrangement according to claim 9, wherein the first and second field electrodes are maintained at a negative voltage to turn the flood beam off.

20. A display arrangement according to claim 13, wherein each additional field electrode means emits a respective flood beam of electrons that is dimensioned to fall on a single region of the mesh electrode.

* * * * *